US011078736B2

(12) United States Patent
Lyon

(10) Patent No.: US 11,078,736 B2
(45) Date of Patent: Aug. 3, 2021

(54) FLOW DIVERSION SUB FOR A DOWN-THE-HOLE DRILL HAMMER

(71) Applicant: Center Rock Inc., Berlin, PA (US)

(72) Inventor: Leland H. Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 694 days.

(21) Appl. No.: 15/875,710

(22) Filed: Jan. 19, 2018

(65) Prior Publication Data

US 2018/0209229 A1 Jul. 26, 2018

Related U.S. Application Data

(60) Provisional application No. 62/448,450, filed on Jan. 20, 2017.

(51) Int. Cl.

| | |
|---|---|
| ***E21B 21/10*** | (2006.01) |
| ***E21B 1/00*** | (2006.01) |
| ***E21B 34/12*** | (2006.01) |
| ***E21B 4/14*** | (2006.01) |
| ***E21B 6/00*** | (2006.01) |

(52) U.S. Cl.

CPC ..... *E21B 21/103* (2013.01); *E21B 1/00* (2013.01); *E21B 4/14* (2013.01); *E21B 6/00* (2013.01); *E21B 34/12* (2013.01)

(58) Field of Classification Search

CPC ..... E21B 1/00; E21B 21/103; E21B 34/12; E21B 4/14; E21B 6/00

See application file for complete search history.

(56) References Cited

U.S. PATENT DOCUMENTS

| | | | | |
|---|---|---|---|---|
| 6,230,823 | B1 * | 5/2001 | Sieniawski | E21B 4/02 175/101 |
| 2005/0194186 | A1 * | 9/2005 | Thorp | E21B 47/20 175/57 |
| 2010/0200301 | A1 * | 8/2010 | Lyon | E21B 4/14 175/296 |
| 2012/0031669 | A1 * | 2/2012 | Foster | E21B 47/017 175/45 |
| 2013/0277043 | A1 * | 10/2013 | Hallundbæk | E21B 34/14 166/188 |
| 2015/0315883 | A1 * | 11/2015 | Yeh | E21B 43/12 166/53 |
| 2018/0023358 | A1 * | 1/2018 | Moyes | E21B 34/14 251/76 |

* cited by examiner

*Primary Examiner* — Christopher J Sebesta
(74) *Attorney, Agent, or Firm* — Kim IP Law Group LLC

(57) ABSTRACT

A flow diversion sub for a down-the-hole drill comprising a housing assembly that includes a housing body, a cap extending from the housing body, and a drive shaft having an upper central blind hole and a lower central blind hole spaced from the upper central blind hole, wherein the drive shaft is received within the housing assembly. In operation, one of the housing assembly and drive shaft moves between a first position and a second position relative to the other of the housing assembly and drive shaft. In the first position the upper central blind hole is in fluid communication with the lower central blind hole, and in the second position the upper central blind hole is blocked from being in fluid communication with the lower central blind hole.

21 Claims, 21 Drawing Sheets

FLOW DIVERSION SUB FOR A DOWN-THE-HOLE DRILL HAMMER

CROSS-REFERENCE TO RELATED APPLICATIONS

The present application claims the benefit of U.S. Provisional Patent Application No. 62/448,450 filed Jan. 20, 2017 entitled "Down-the-Hole Drill Hammer with Flow Diversion Sub," the entire disclosure of which is hereby incorporated herein by reference for all purposes.

BACKGROUND OF THE DISCLOSURE

Typical down-the-hole drill ("DHD") hammers involve a combination of percussive and rotational movement of the drill bit to drill or chip away at rock. Such DHD hammers are powered by a rotatable drill string attached to a drilling platform that supplies rotation and high pressure gases (e.g., air) for percussive drilling. Moreover, in percussive drilling, rock cutting is a result of percussive impact forces rather than shear forces. In other words, rotation of the DHD hammer serves to rotationally index the drill bit to fresh rock formations after the drill bit impacts a rock surface rather than to impart shear cutting forces to the rock surface.

It is common in directional down-the-hole drilling applications to attach a rotational motor above a DHD hammer to provide rotation of the hammer and bit without the requirement to rotate the drill string. One of the problems with such a drilling system involves a drilling process known as circulation. Circulation is a non-drilling process where air and fluids are simply circulated through the bore to clean spoils and cuttings from the hole. During circulation, flow passes through the motor and into the hammer which is off-bottom and bypassing air. That is, the hammer is not operating. However, as long as flow passes through it, the motor continues to rotate which allows the hammer and the down-the-hole bit to spin at high speed in an uncontrolled manner. As a result, the bit may suffer damage and wear even when it is not being used to advance the hole.

BRIEF SUMMARY OF THE DISCLOSURE

The exemplary embodiments of present invention relate generally to a flow diversion sub for a down-the-hole drill and, more specifically, to a flow diversion sub for a down-the-hole drill having the ability to redirect up to 100% of the motor and hammer flow away from the motor and hammer while circulating.

In accordance with an exemplary embodiment there is provided a flow diversion sub for a down-the-hole drill comprising a housing assembly that includes a housing body, a cap extending from the housing body, and a drive shaft having an upper central blind hole and a lower central blind hole spaced from the upper central blind hole, wherein the drive shaft is received within the housing assembly. One of the housing assembly and drive shaft moves between a first position and a second position relative to the other of the housing assembly and drive shaft. In the first position the upper central blind hole is in fluid communication with the lower central blind hole, and in the second position the upper central blind hole is at least partially blocked from being in fluid communication with the lower central blind hole.

An aspect of the exemplary embodiment is that the drive shaft further includes an exhaust port in fluid communication with the upper central blind hole. The exhaust port is in fluid communication with an exterior of the flow diversion sub when in the second position.

Another aspect of the exemplary embodiment is that the drive shaft further includes a drive port in fluid communication with the upper central blind hole and a receiving port in fluid communication with the lower central blind hole, and wherein the drive port is in fluid communication with the receiving port when in the first and second positions. The drive shaft further includes a restrictor at least partially occluding fluid communication in the upper central blind hole. The restrictor is removably positionable in the drive port.

Another aspect of the exemplary embodiment is that the housing body includes an inwardly extending flange configured to facingly engage the drive shaft either above or below the exhaust port.

Another aspect of the exemplary embodiment is that each of the drive port and receiving port extends substantially radially and the drive port is axially spaced from the receiving port.

Another aspect of the exemplary embodiment is that the flow diversion sub further comprises an exhaust chamber between the housing body and the drive shaft, wherein the exhaust chamber is in fluid communication with an exterior of the flow diversion sub, and wherein the exhaust chamber includes a drive tube in fluid communication with the exhaust port when in the second position.

Another aspect of the exemplary embodiment is that the flow diversion sub further comprises a drive chamber formed by the housing body and drive shaft, wherein the drive chamber is spaced from the exhaust chamber and not in fluid communication with the exhaust chamber.

Another aspect of the exemplary embodiment is that the cap is releasably connected to the housing body and the cap includes a central through hole.

Another aspect of the exemplary embodiment is that the flow diversion sub further comprises a check valve between the housing body and drive shaft for controlling a flow of air between the housing body and drive shaft.

In accordance with another exemplary embodiment there is provided a down-the-hole drill assembly comprising a drill string, the flow diversion sub of the exemplary embodiment described above attached to the drill string, and a motor operatively attached to the flow diversion sub.

In accordance with yet another exemplary embodiment there is provided a flow diversion sub for a down-the-hole drill hammer comprising a housing including an internally facing annular recess and a plurality of internally facing pockets spaced from the internally facing annular recess and a drive shaft movably received in the housing. The drive shaft comprises an upper portion configured for fluid connection to a drill string or weight collars, the upper portion including an upper axial blind hole and a plurality of externally facing pockets opposite the plurality of internally facing pockets. The drive shaft further includes a lower portion including a lower axial blind hole and an intermediate portion. The intermediate portion includes a first plurality of radial passages in fluid communication with the upper axial blind hole, a second plurality of radial passages in fluid communication with the lower axial blind hole, and a wall separating the upper axial blind hole from the lower axial blind hole. The flow diversion sub further includes a cap connecting the drive shaft to the housing, the cap having an axial blind hole in fluid communication with the lower axial blind hole and configured for fluid connection to a motor.

An aspect of the yet another exemplary embodiment is that wherein, in a first position of the drive shaft, the upper axial blind hole, the first plurality of radial passages, the internally facing annular recess, the second plurality of radial passages and the lower axial blind hole are in fluid communication, and wherein, in a second position of the drive shaft, the upper axial blind hole, the first plurality of radial passages, the plurality of internally facing pockets, and the plurality of externally facing pockets are in fluid communication with an exterior of the flow diversion sub.

Another aspect of the exemplary embodiment is that wherein the first position of the drive shaft corresponds to a drilling mode of the down-the-hole drill hammer, and wherein the second position of the drive shaft corresponds to a circulating mode of the down-the-hole drill hammer.

In accordance with the exemplary embodiments, there is provided a flow diversion sub for a down-the-hole drill that effectively redirects a portion or up to 100% of working fluid of the motor and hammer flow away from the motor and hammer while the drill hammer is in a circulating mode. In other words, rather than having a continuous central bore which provides direct fluid flow through the sub, regardless of whether the sub is on-bottom or off-bottom (i.e., in contact with or out of contact with the cap), the flow diversion sub operates like a three-way valve where inlet flow is either directed to the motor-hammer or directed into the annulus at the exterior of the sub as exhaust flow. By having this flow diversion feature, a portion or up to 100% of the flow can be directed away from the rotation motor causing it to stop and minimize or cause no detrimental harm to the down-the-hole hammer during circulating mode. Alternatively, the flow direction sub may be configured to direct some flow to the motor or hammer and thus to the drill bit during circulating mode when such reduced flow is desired or necessary.

Other features and advantages of the subject disclosure will be apparent from the following more detail description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

In the drawings.

DETAILED DESCRIPTION OF THE INVENTION

Figure 1:
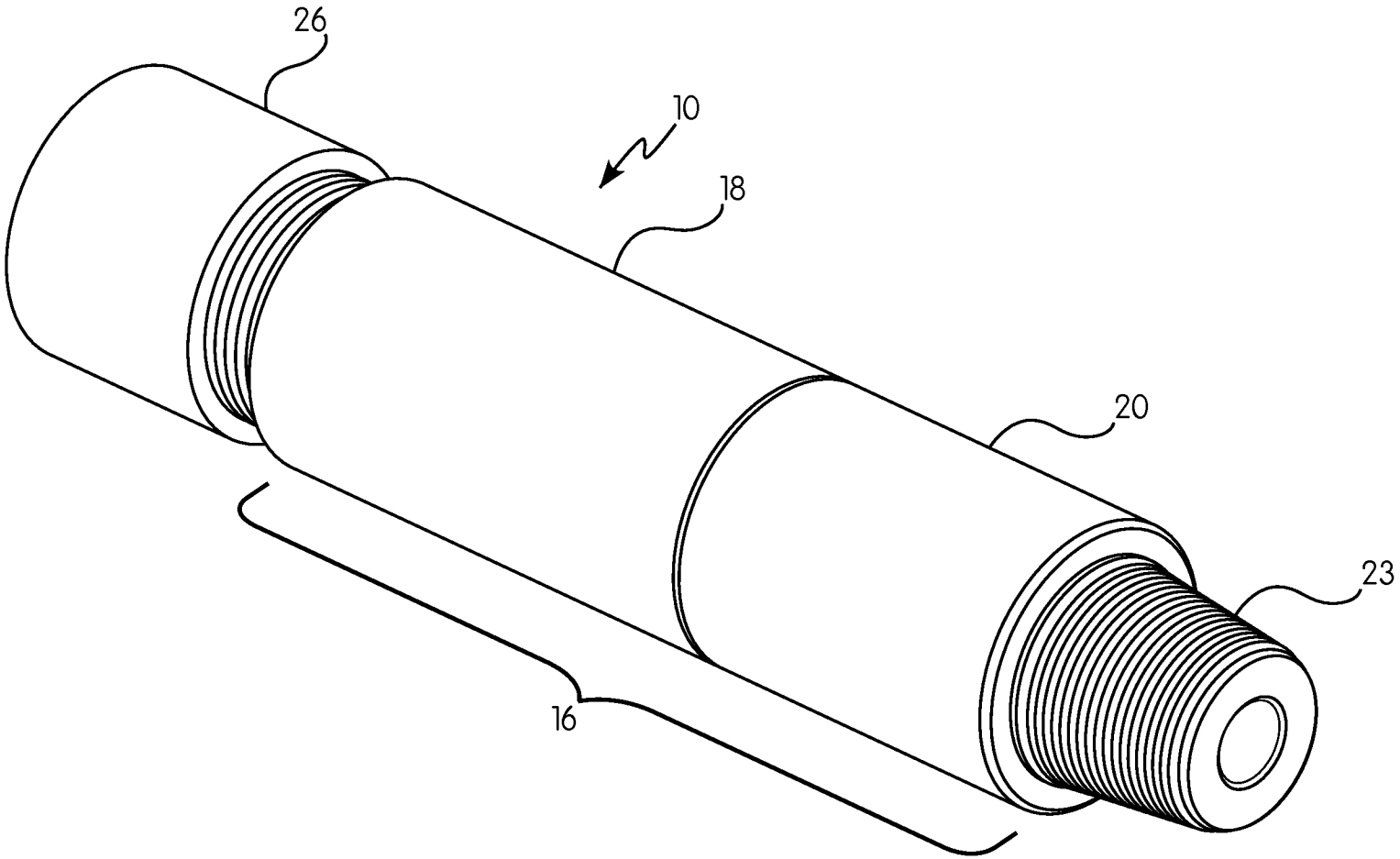
FIG. 1 is a perspective view of a flow diversion sub in accordance with an exemplary embodiment of the subject disclosure.
Figure 2:
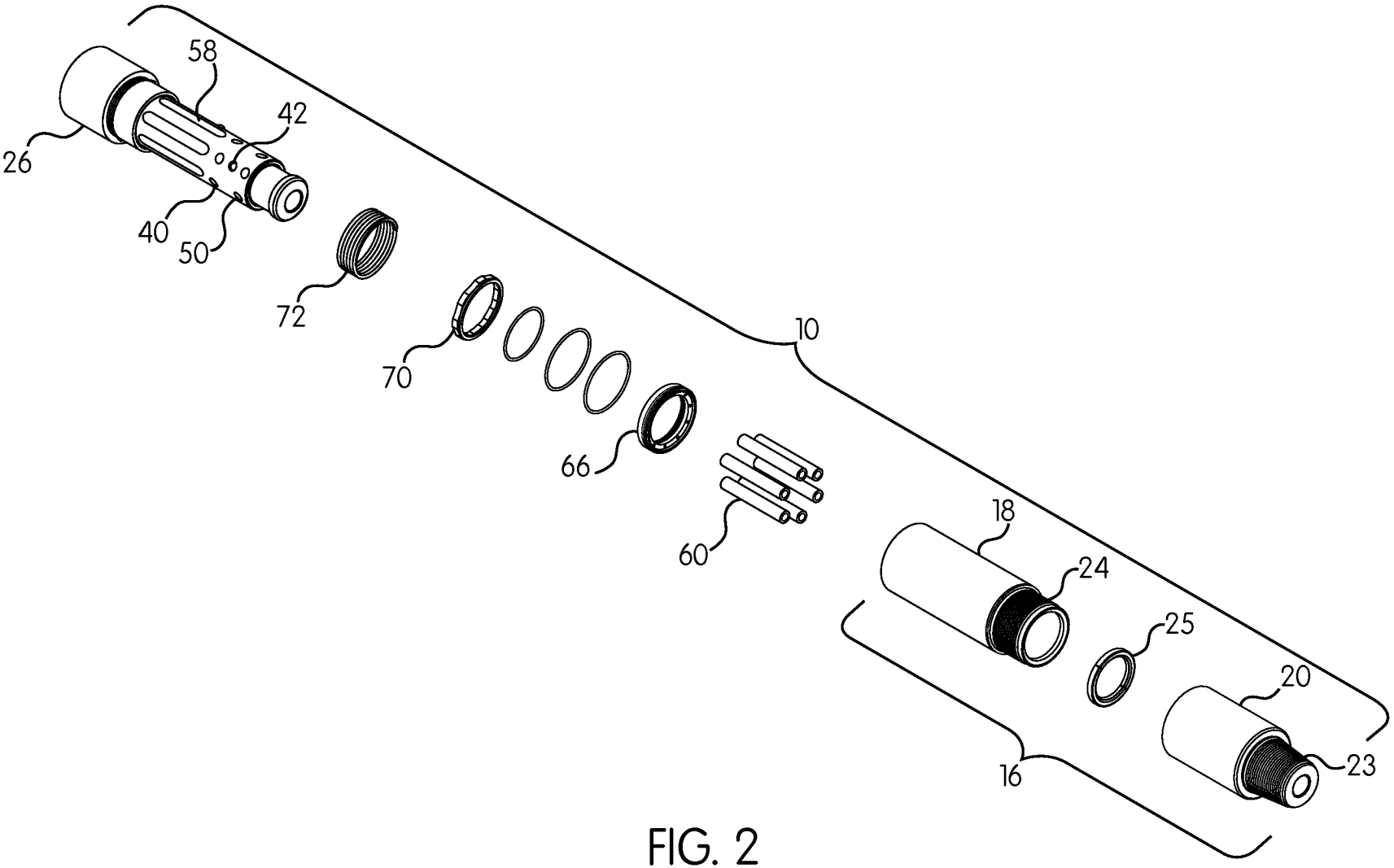
FIG. 2 is an exploded perspective view of the flow diversion sub of FIG. 1.
Figure 3:
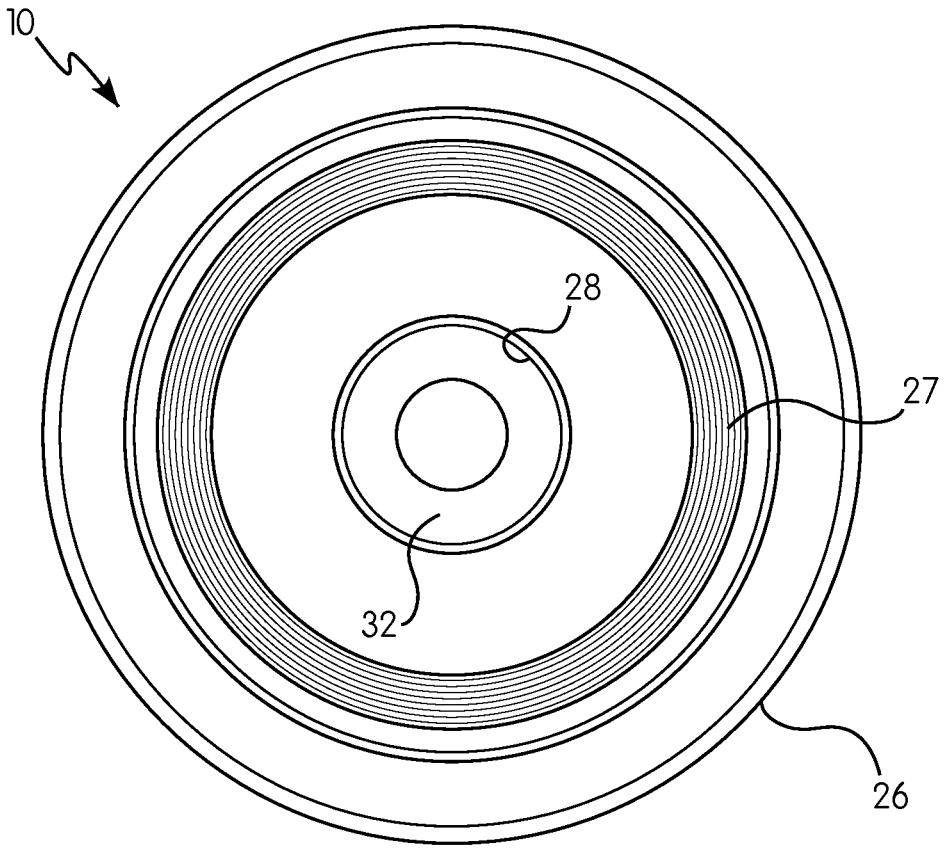
FIG. 3 is a top plan view of the flow diversion sub of FIG. 1.
Figure 4:
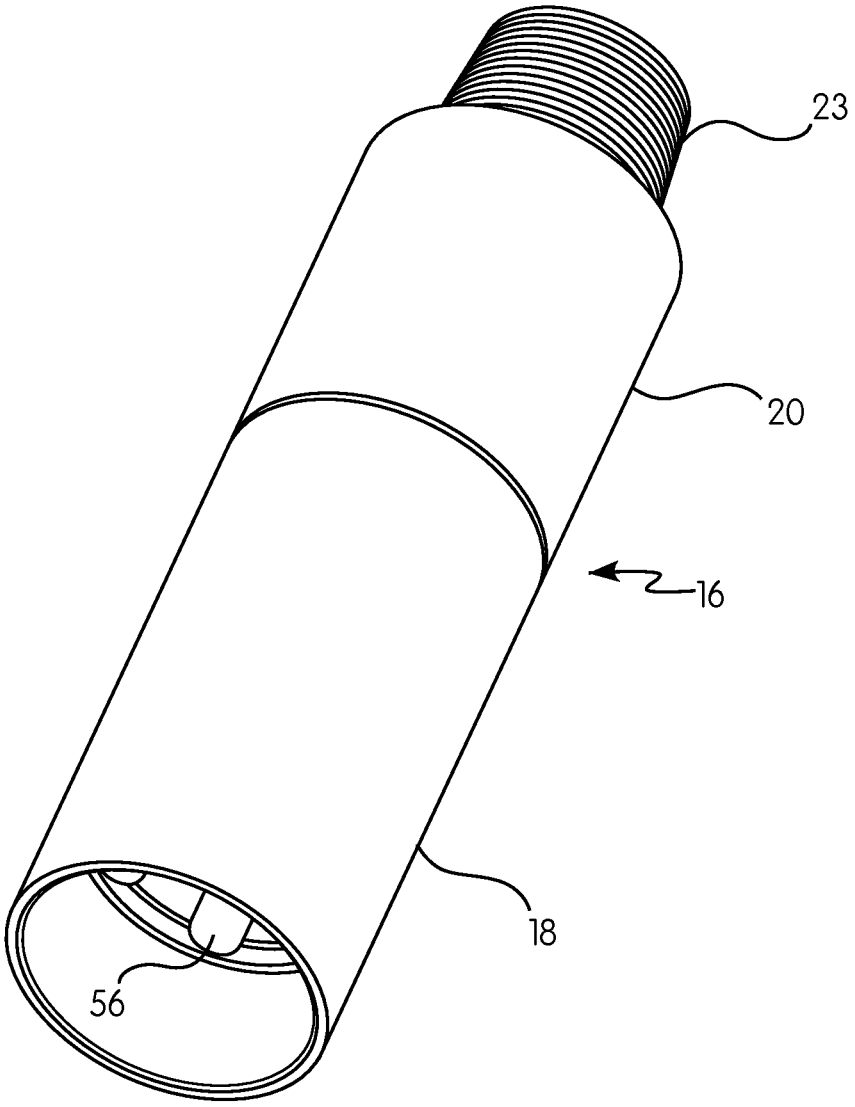
FIG. 4 is a bottom perspective view of a housing assembly of the flow diversion sub of FIG. 1.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. The words "right," "left," "lower" and "upper" designate directions in the drawings to which reference is made. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 24:
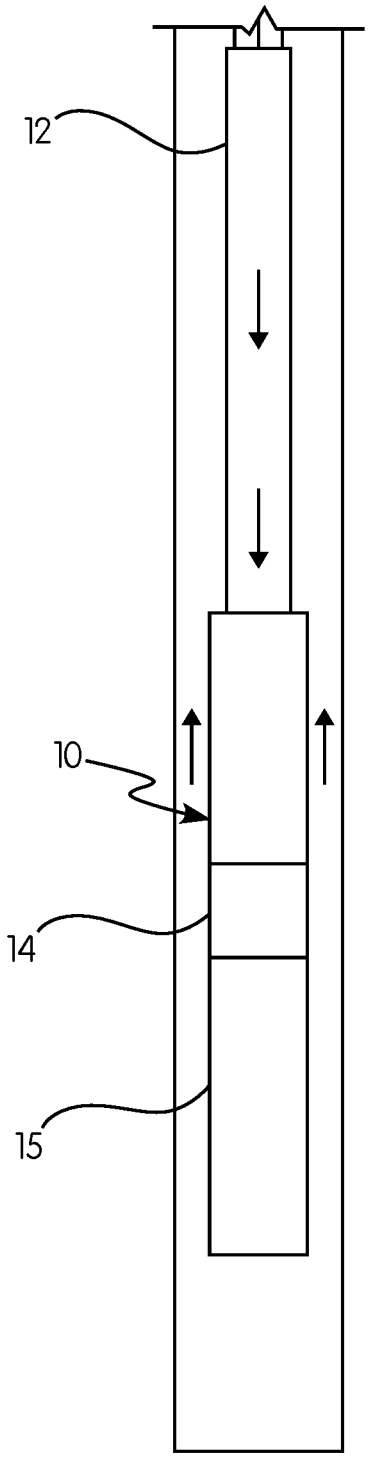
FIG. 24 is an elevational schematic view of a down-the-hole drill hammer including a drill string, the flow diversion sub of FIG. 1, a drill motor and a DHD hammer.

Referring to FIG. 1, there is shown a flow diversion sub 10 for a DHD hammer in accordance with an exemplary embodiment of the subject disclosure. In operation, as shown in FIG. 24, the flow diversion sub 10 is threadedly and fluidly connected at its upper or proximal end to a drill string and/or weight collars 12 and threadedly and fluidly connected at its lower or distal end to a drill motor 14. The drill motor, in turn, is operatively connected to a DHD hammer 15. Drilling and circulating fluid respectively passes through the drill string and/or weight collars and into the flow diversion sub 10.

Figure 6:
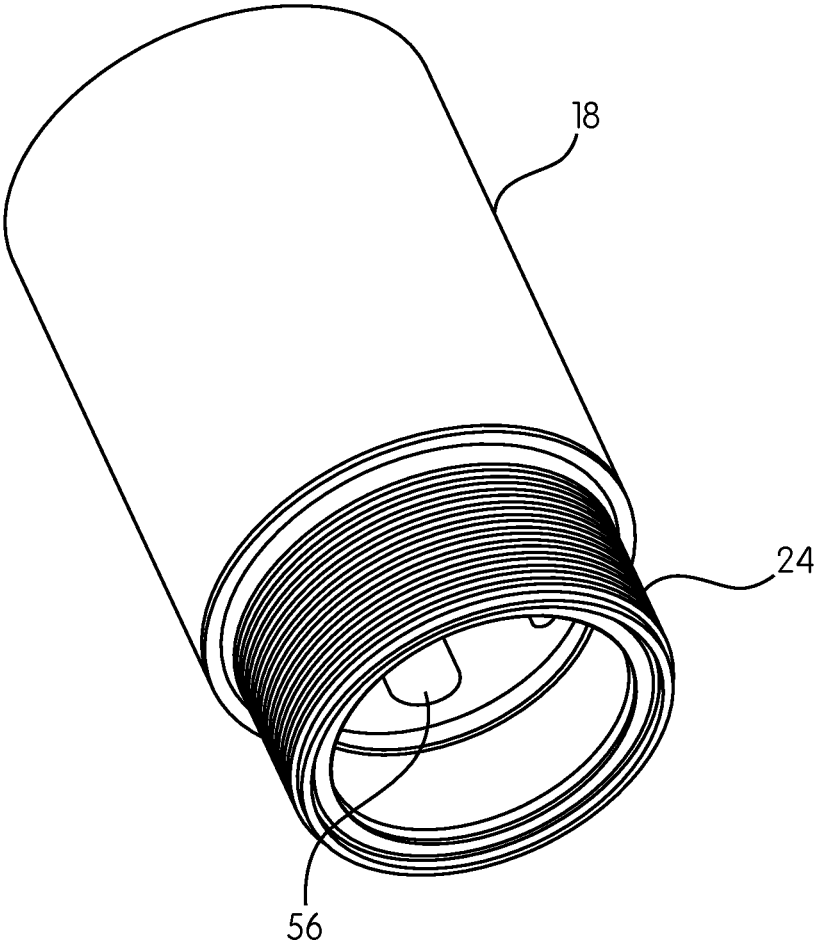
FIG. 6 is a bottom perspective view of a housing body of the flow diversion sub of FIG. 1.
Figure 7:
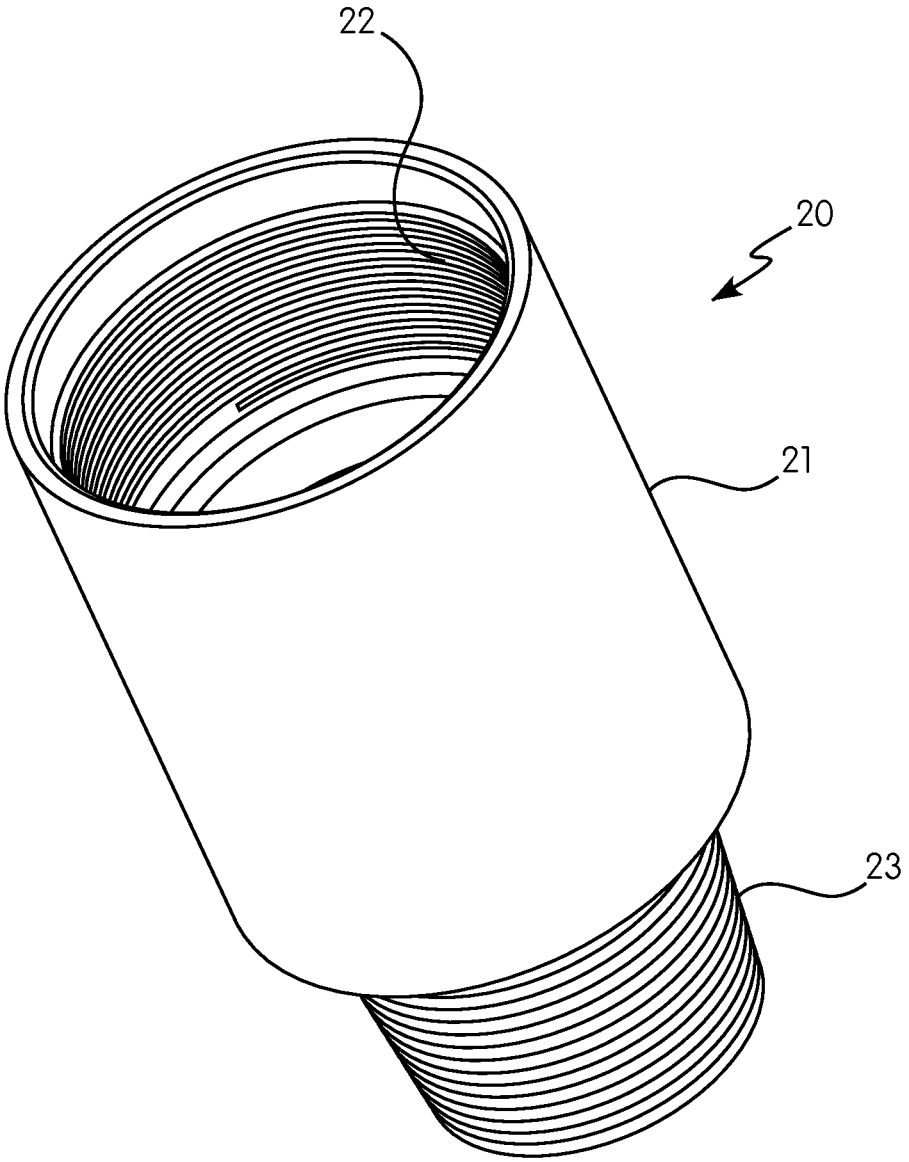
FIG. 7 is a top perspective view of a cap of the flow diversion sub of FIG. 1.

According to an exemplary embodiment, the flow diversion sub 10 comprises a housing assembly 16 that, as most clearly shown in FIGS. 1, 2, 4 and 5, includes a housing body 18 and a cap 20 extending from the housing body. The housing body 18 is tubular as shown in FIG. 6 and the cap 20 is likewise tubular as shown in FIG. 7. The housing body and cap are shown as separate components but can alternatively be configured as a unitary part.

Figure 5:
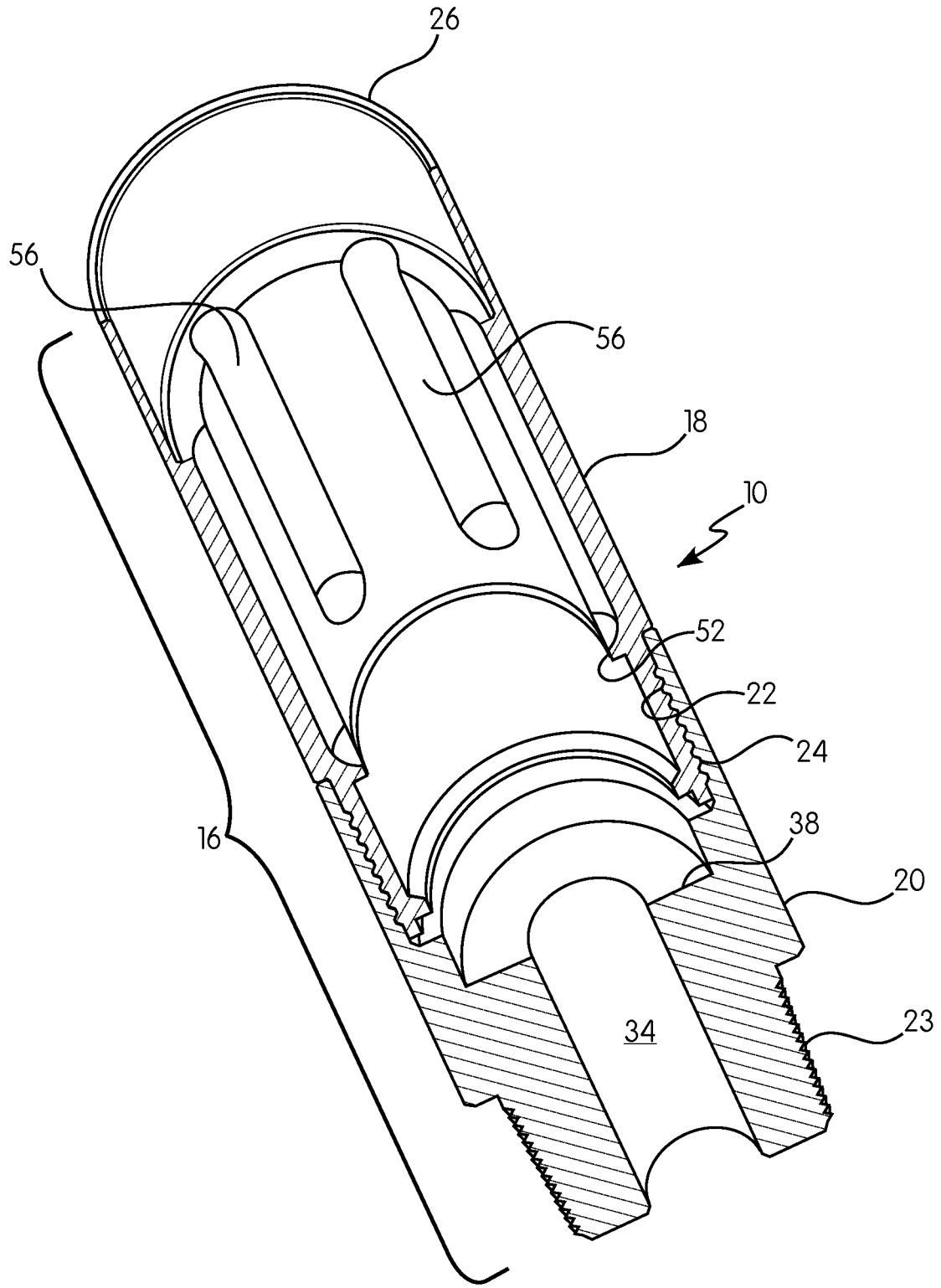
FIG. 5 is a perspective cross-sectional view of the housing assembly of the flow diversion sub of FIG. 1.

The cap 20 is configured as best shown in FIGS. 5 and 7 having a tubular body 21. The cap 20 also includes a fastener, e.g., internal threading 22 at its upper or proximal end which threadedly engages external threading 24 provided on a lower or distal end of housing body 18 (FIG. 5), as well as threading 23, extending distally from its distal end for threadedly engaging the motor 14 (FIG. 24). The cap 20 further includes a radially inwardly directed annular seat 38 for receiving a lower end 36 of a drive shaft 26, discussed in greater detail below.

Figure 13:
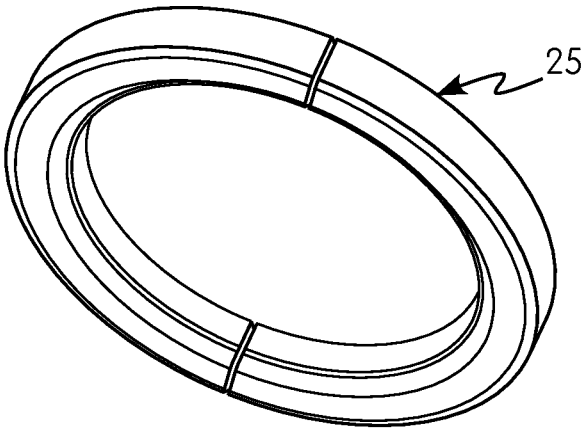
FIG. 13 is a bottom perspective view of a housing assembly retainer ring of the flow diversion sub of FIG. 1.

A split retainer ring 25 (FIGS. 2 and 13) is disposed between opposed shoulders of the housing body 18 and the cap 20 (FIGS. 18-22) and serves to limit the range of motion of the housing assembly 16 and a drive shaft 26 between first and second positions, discussed below.

Figure 8:
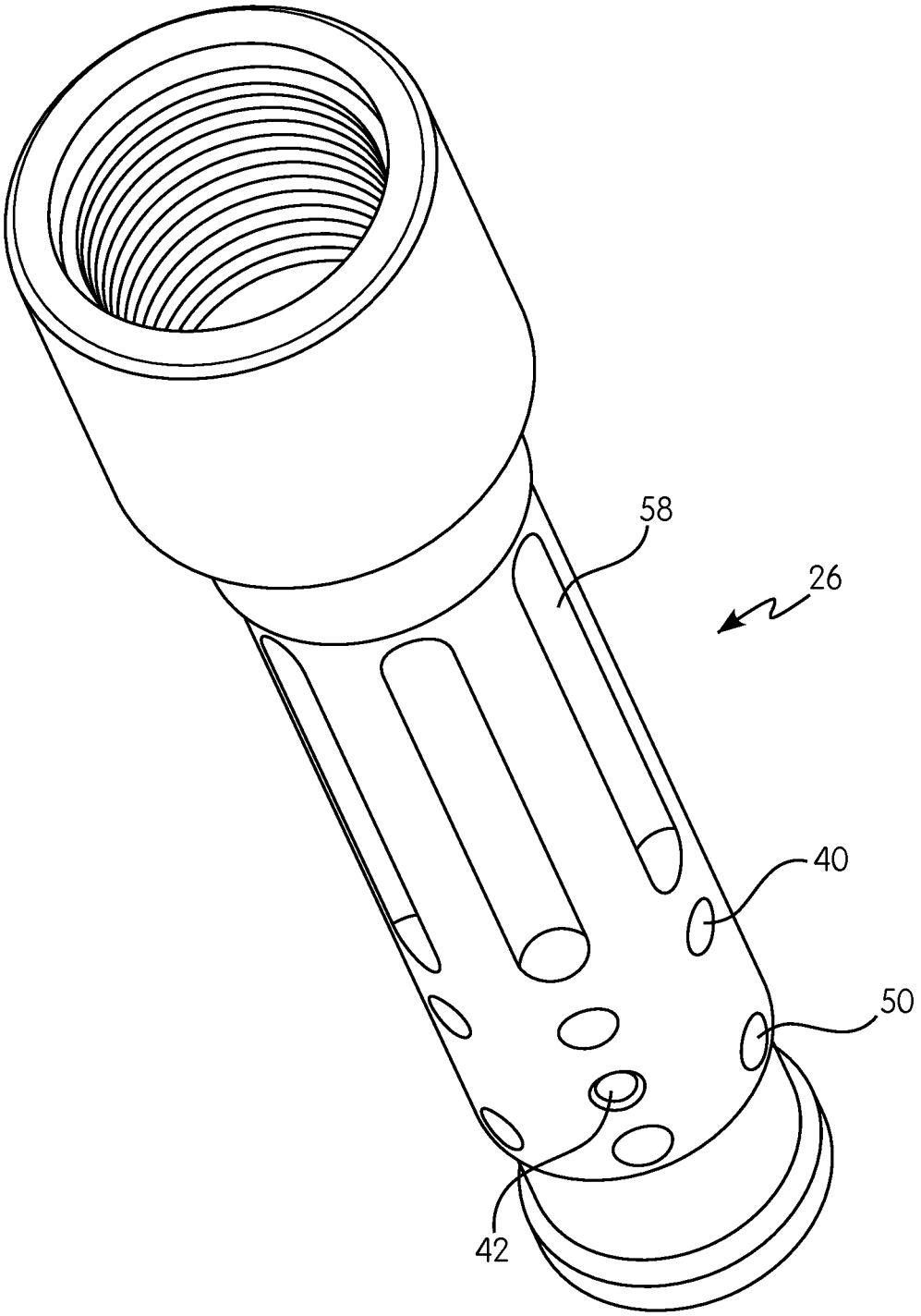
FIG. 8 is a top perspective view of a drive shaft of the flow diversion sub of FIG. 1.
Figure 9:
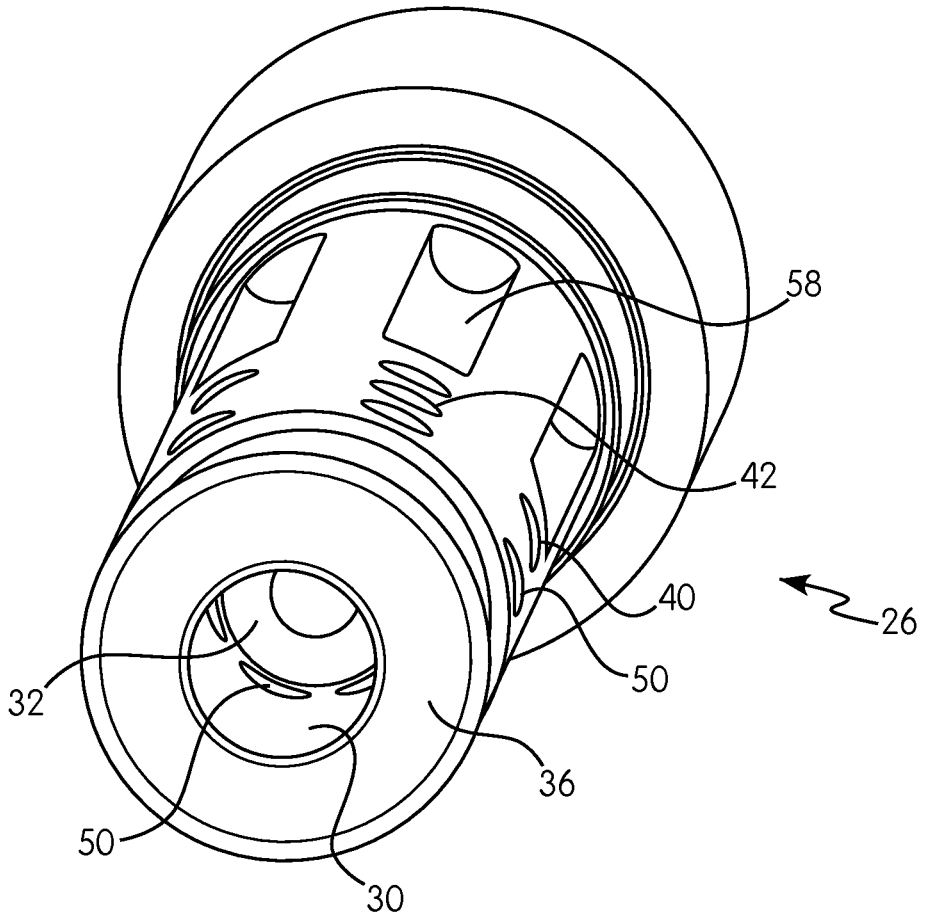
FIG. 9 is a bottom perspective view of the drive shaft of FIG. 8.
Figure 10:
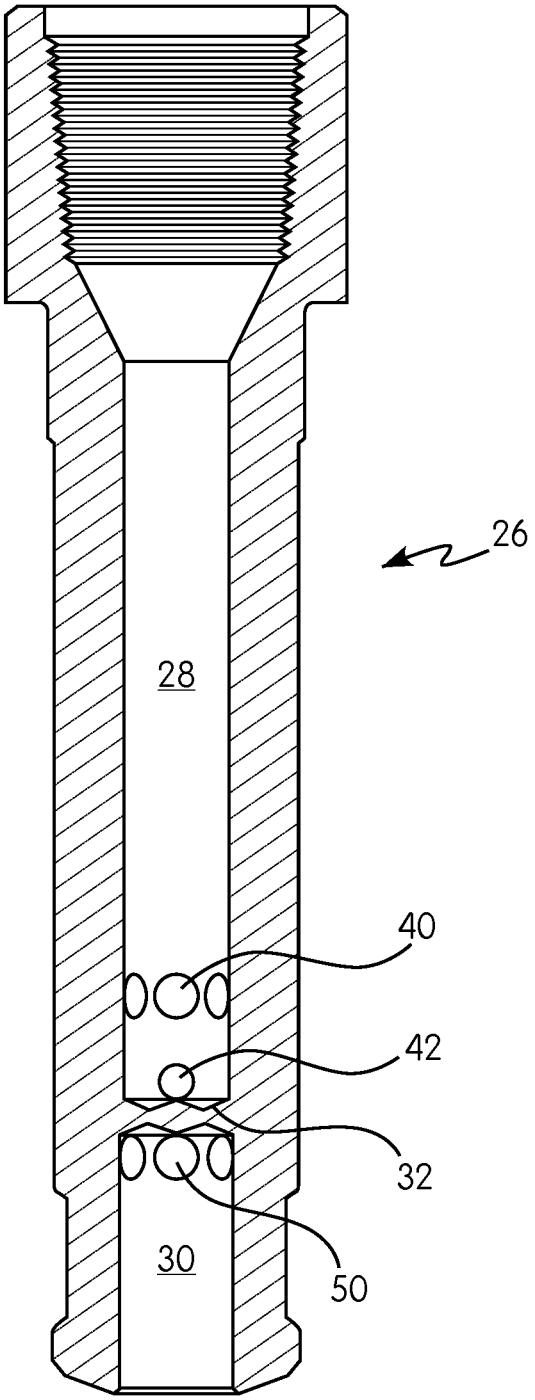
FIG. 10 is an elevational cross-sectional view of the drive shaft of the flow diversion sub of FIG. 1.

Referring to FIGS. 2, 3 and 8-11 the flow diversion sub further comprises a drive shaft 26 configured, e.g., as best shown in FIGS. 8-10. The drive shaft 26 is received within the housing assembly 16 as shown in FIGS. 18-22. The drive shaft includes a fastener, e.g., internal threading 27 (FIGS. 3, 8, 10 and 18-22) provided on an upper or proximal end which threadedly engages external threading of the drill string 12. The drive shaft 26 further includes an upper central blind hole 28 (FIGS. 3, 10 and 18-22) and a lower central blind hole 30 (FIGS. 9, 10, 11 and 18-22) spaced along a longitudinal axis of the drive shaft from the upper central blind hole. FIGS. 3, 9, 10 and 18-22 show that the upper and lower central blind holes 28, 30 are separated by a wall 32.

As illustrated in FIGS. 18-22, the cap 20 is releasably connected to the housing body 18 and includes a central through hole 34 in fluid communication with the lower central blind hole 30 and configured for fluid connection to the motor 14 (FIG. 24).

The drive shaft moves between a first position and a second position within the housing assembly. The first position of the drive shaft corresponds to an "on-bottom" drilling mode of the DHD hammer, e.g., when the drill bit of the DHD hammer engages earth, and the second position of the drive shaft corresponds to an "off-bottom" circulating mode of the DHD hammer, e.g., when the drill bit of the DHD hammer does not engage earth.

Figure 18:
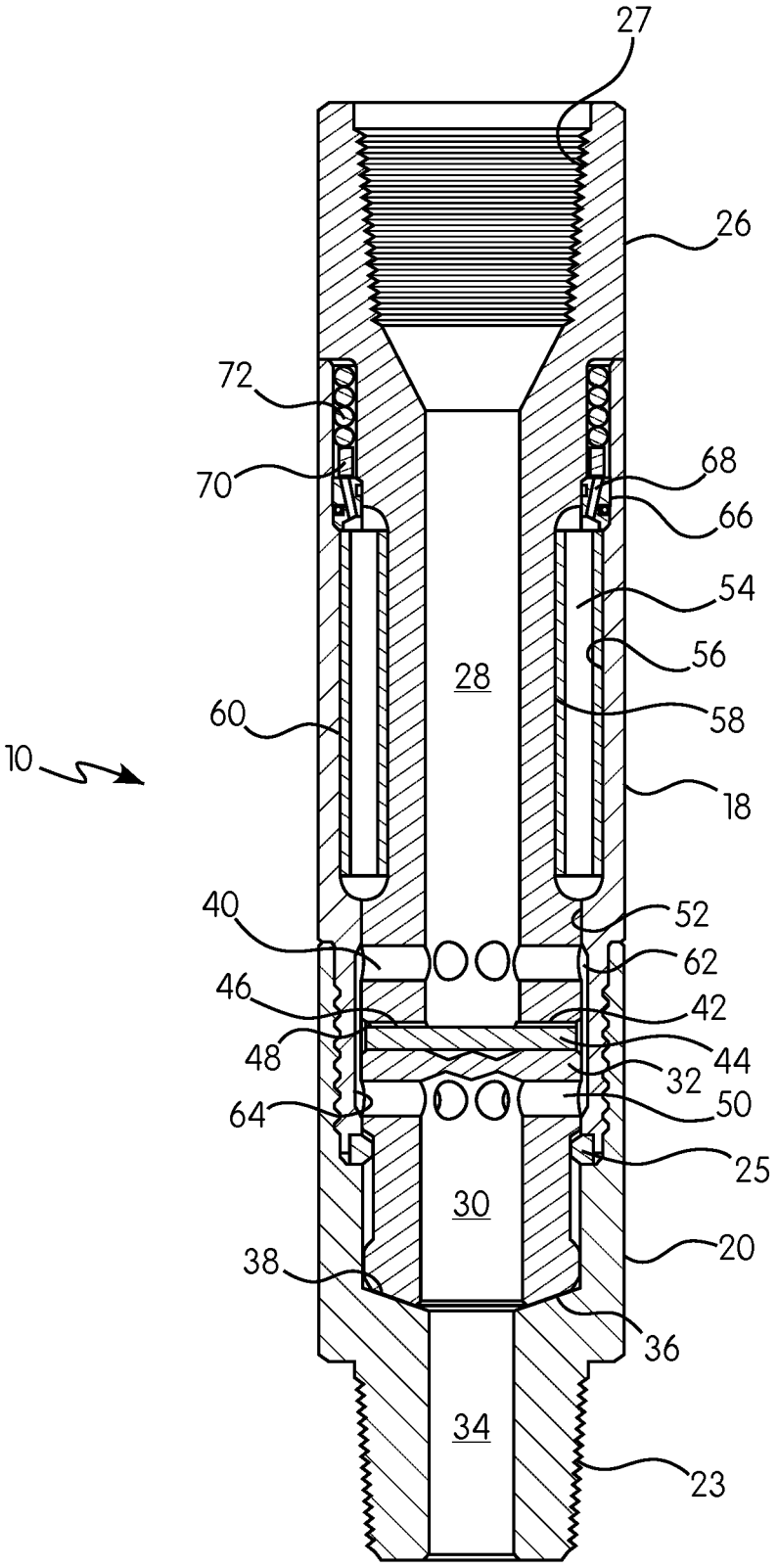
FIG. 18 is an elevational cross-sectional view of the flow diversion sub of FIG. 1 in an "on-bottom" drive mode with a removable flow restrictor pin thereof installed.
Figure 19:
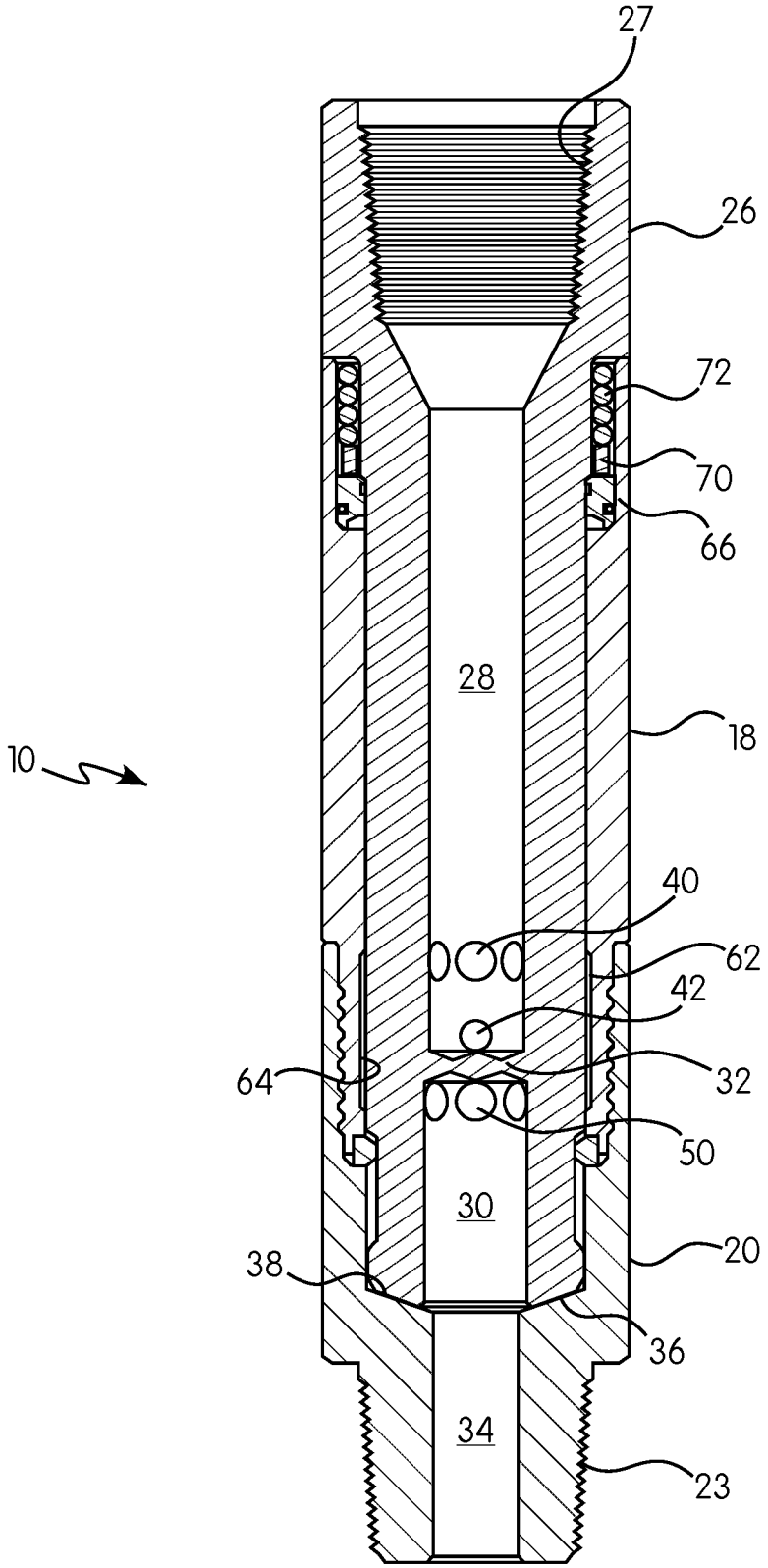
FIG. 19 is another elevational cross-section view of the flow diversion sub of FIG. 1 in an "on-bottom" drive mode with a removable flow restrictor pin thereof omitted for clarity of illustration and rotated 90 degrees about its longitudinal axis from the image position shown in FIG. 18.
Figure 20:
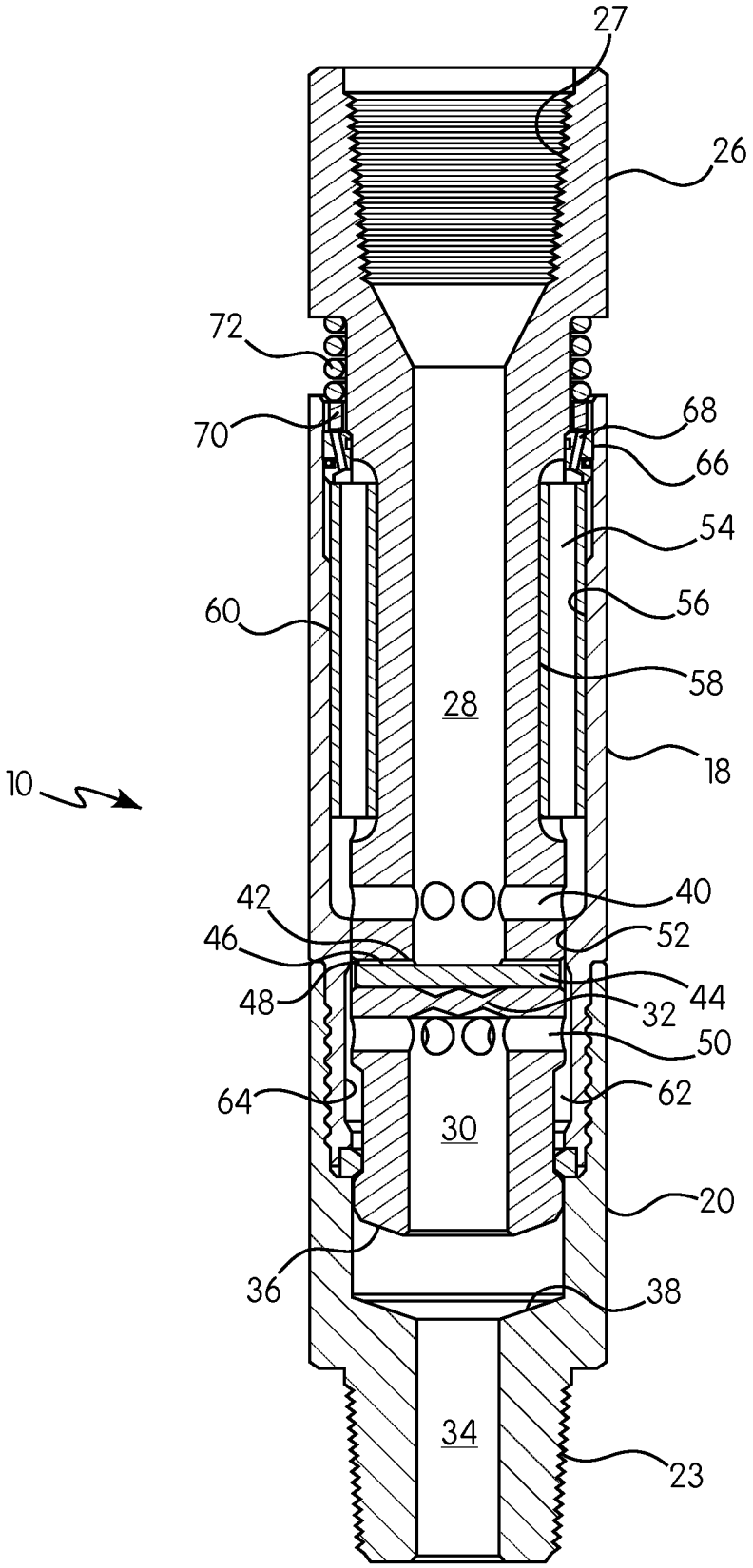
FIG. 20 is an elevational cross-sectional view of the flow diversion sub of FIG. 1 in an "off-bottom" circulating mode with a removable flow restrictor pin thereof installed.
Figure 21:
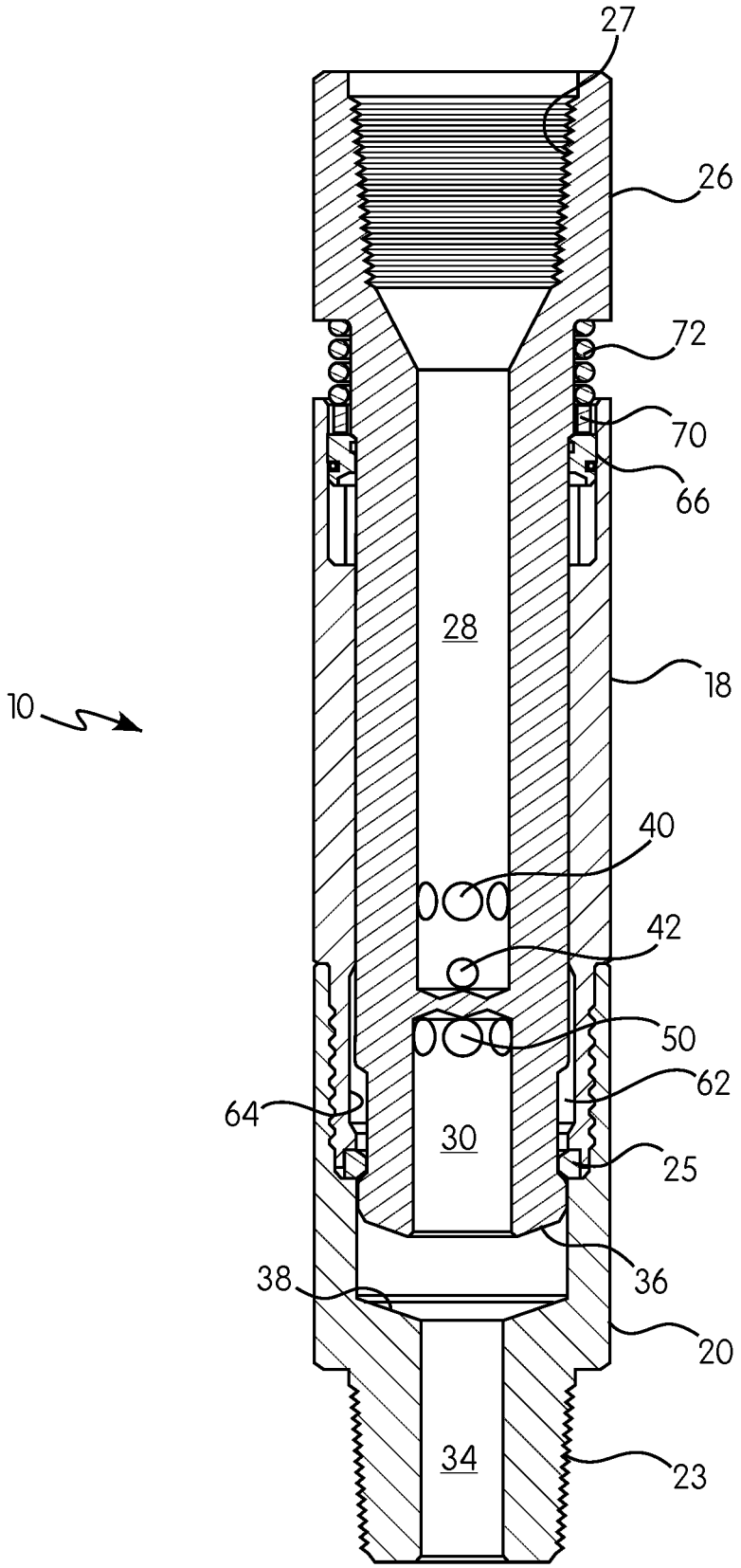
FIG. 21 is another elevational cross-sectional view of the flow diversion sub of FIG. 1 in an "off-bottom" circulating mode with a removable flow restrictor pin thereof omitted for clarity of illustration and rotated 90 degrees about its longitudinal axis from the image position shown in FIG. 20.
Figure 22:
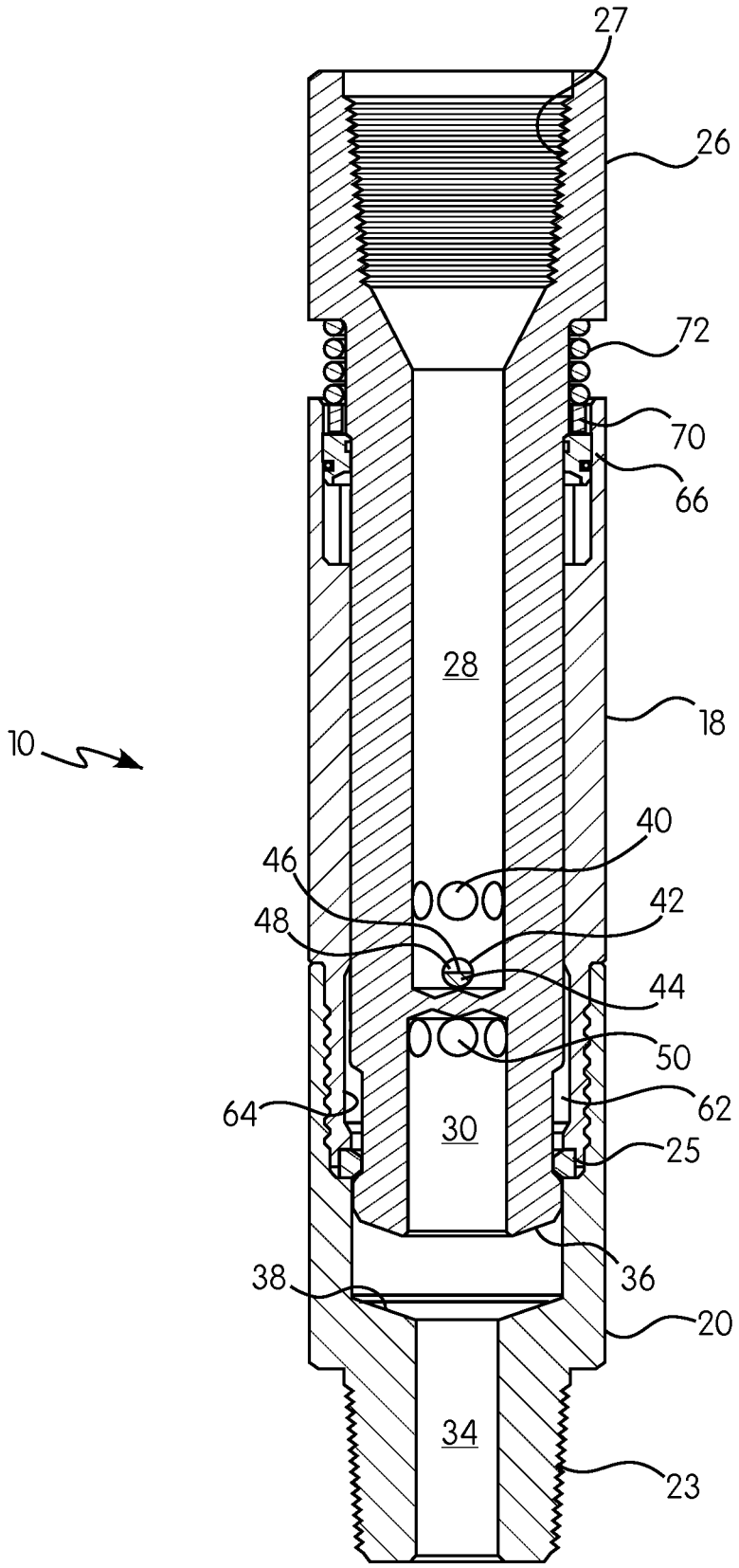
FIG. 22 is an elevational cross-sectional view of the flow diversion sub of FIG. 1 in an "off-bottom" circulating mode rotated 90 degrees about its longitudinal axis from the image position shown in FIG. 20.
Figure 23:
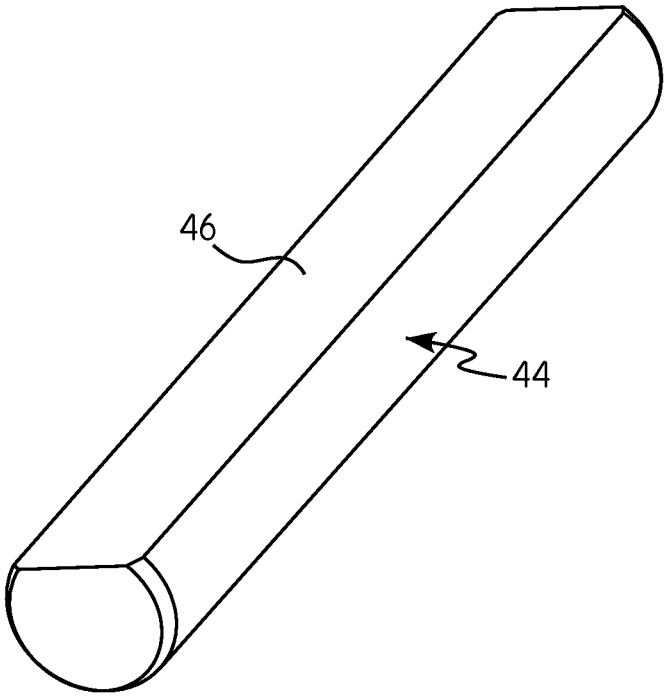
FIG. 23 is an enlarged perspective view of a removable flow resistor pin configured for insertion into a drive port of the flow diversion sub of FIG. 1.

The drive shaft 26 further includes an exhaust port 40 (FIGS. 2, 8, 9 and 11) in fluid communication with the upper central blind hole 28 (FIGS. 10, and 18-22). According to an exemplary embodiment, the exhaust port 40 may be a single substantially radially disposed exhaust port or a plurality of substantially radially disposed ports. As seen in FIGS. 20-22 and as described below, the exhaust port 40 is in fluid communication with an exterior of the flow diversion sub when in the second position via an exhaust porting pathway.

The drive shaft additionally includes a drive port 42 (FIGS. 2, 8, 9 and 11) in fluid communication with the upper central blind hole 28 (FIGS. 10 and 18-22) and an exterior of the drive shaft. According to an exemplary embodiment, the drive port 42 may be a single substantially radially disposed exhaust port, a plurality of substantially radially disposed exhaust ports, or a pair of substantially radially disposed collinear ports (FIGS. 18, 20 and 22) adapted to removably receive a restrictor or metering device 44 (FIGS. 18, 20, 22 and 23), e.g., a restrictor pin, for controlling or metering of a flow rate of fluid flow which passes through the drive port(s) of the drive shaft when in the second position. Additionally, the restrictor pin 44 may have a cross-section sized and shaped to essentially occlude the drive port(s) 42 to prevent air or other fluid from passing through the drive port(s) when the drive shaft is in the first position or the second position. In the event the restrictor pin 44 is sized and shaped to essentially completely occlude the drive port(s) 42, all of the motor and hammer flow will be directed away from the motor and hammer while in circulating mode (second position), i.e., the upper central blind hole 28 will be blocked from being in fluid communication with the lower central blind hole 30.

As seen in FIGS. 18, 20, 22 and 23, the restrictor pin 44 may be provided with a flattened or otherwise recessed surface 46 along its length, thereby establishing a gap 48 (FIGS. 18, 20 and 22) between the restrictor pin and the inner walls of the drive port(s) 42 which permits a controlled or metered amount of drive flow to reach the motor during drive mode (FIG. 18) and a portion of circulating flow to reach the motor during circulating mode (FIGS. 20 and 22).

The drive shaft 26 further includes a receiving port 50 (FIGS. 2, 8, 9 and 11) in fluid communication with the lower central blind hole 30 (FIGS. 10 and 18-22) and an exterior of the drive shaft. The drive port 42 is axially spaced from the receiving port 50 along a longitudinal axis of the drive shaft. According to an exemplary embodiment, the receiving port 50 may be a single substantially radially disposed exhaust port or a plurality of substantially radially disposed ports. Unless the drive port 42 is completely occluded by the restrictor pin 44 as discussed above, the drive port 42 is in fluid communication with the receiving port 50 when in the first or second position via a passageway formed between the drive port and the housing assembly, whereby a portion of the working fluid flow will be directed toward the motor and hammer while in the circulating mode (i.e., second position).

In sum, one of the housing assembly 16 and drive shaft 26 moves between a first position and a second position relative to the other of the housing assembly and drive shaft. In the first position (described in greater detail below in connection with FIGS. 18 and 19) the upper central blind hole 28 is in fluid communication with the lower central blind hole 30, and in the second position (FIGS. 20-22, described below) the upper central blind hole 28 is wholly or partially blocked from fluid communication with the lower central blind hole 30.

Referring to FIGS. 5, 18 and 20, the housing body 18 further includes an inwardly extending flange 52. In addition, an exhaust chamber 54 is located between the housing body 18 and the drive shaft 22 (FIGS. 18 and 20). The exhaust chamber is in fluid communication with an exterior of the flow diversion sub. The inwardly extending flange 52 is configured to sealingly and/or facingly engage the drive shaft either above or below the exhaust port 40. Due to the flange's inwardly extent, it forms a passageway to allow fluid communication between the exhaust port and exhaust chamber 54 when in the second position.

In the first position (FIG. 18), the inwardly extending flange 52 engages the drive shaft above the exhaust port and due to its inwardly extent forms part of the annular recess 64 which is in fluid communication with exhaust port 40 and receiving port 50. According to an exemplary embodiment, the exhaust chamber 54 may be a single chamber or a plurality of chambers disposed about the periphery of the drive shaft 26 and an internal wall of the housing body. Each exhaust chamber 54 may be formed, e.g., by an internally facing pocket 56 (FIGS. 4-6, 18 and 20) provided by the housing body 18 and an externally facing pocket 58 (FIGS. 2, 8, 9, 18 and 20) provided by the drive shaft 26.

Figure 11:
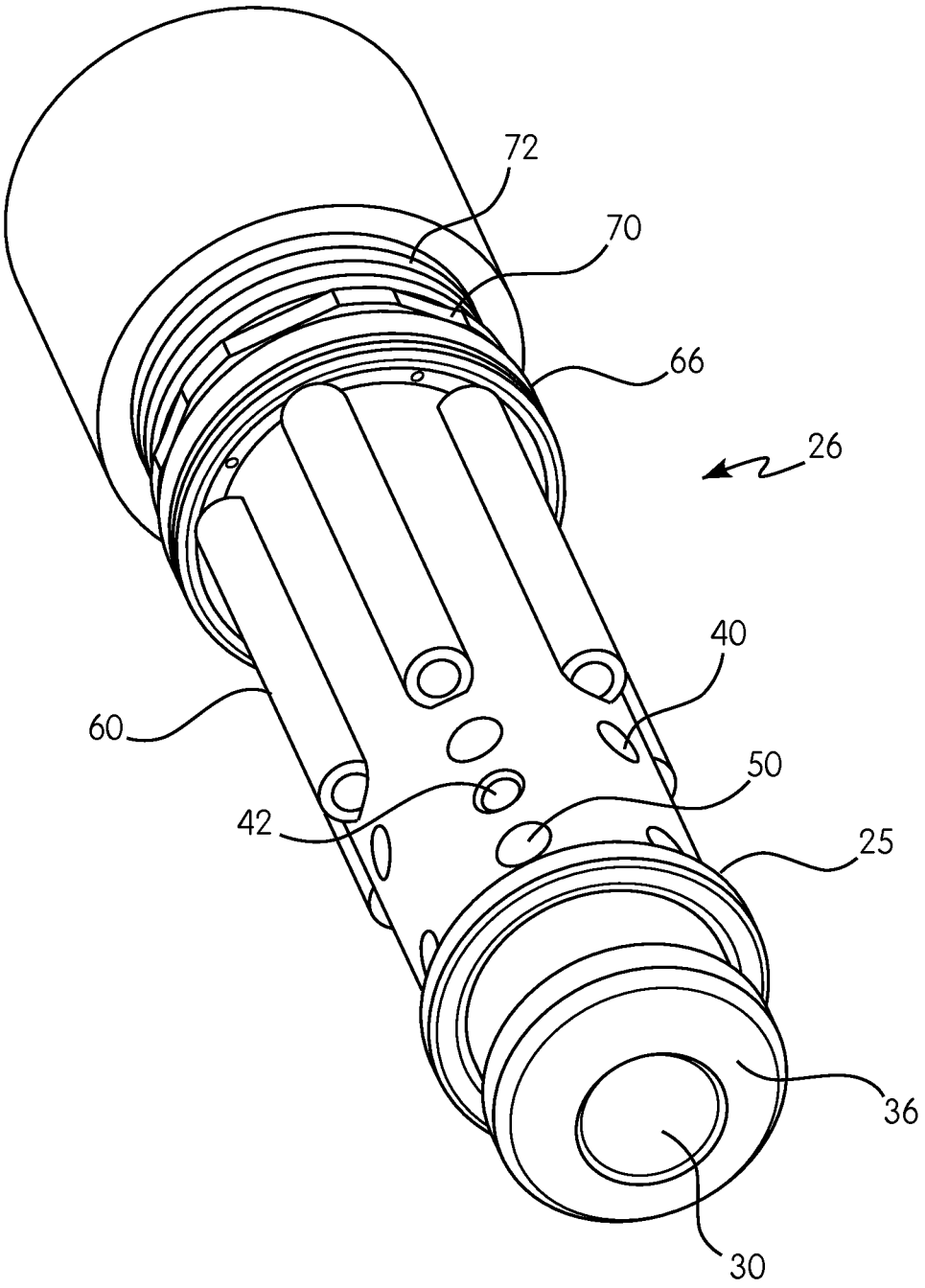
FIG. 11 is another bottom perspective view the drive shaft of the flow diversion sub of FIG. 8 with additional components of the flow diversion sub shown.
Figure 12:
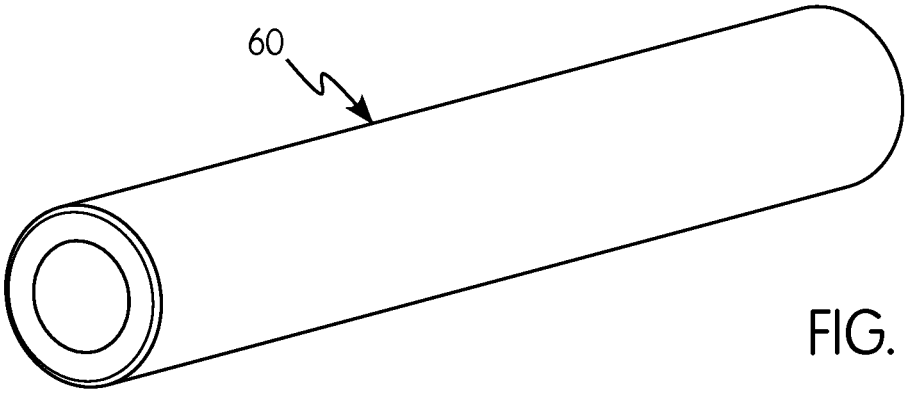
FIG. 12 is a perspective view of a drive tube of the flow diversion sub of FIG. 1.

The exhaust chamber 54 may comprise a drive tube 60 in fluid communication with the exhaust port 40 when in the second position. FIG. 11 shows the drive tubes partially seated in the externally facing pockets of the drive shaft 26, whereas FIGS. 18 and 20 show the drive tubes wholly seated in the externally facing pockets 58 of the drive shaft 26 and the internally facing pockets 56 of the housing body 18. An enlarged view of a drive tube 60 is shown in FIG. 12 which shows that the drive tube is hollow and essentially cylindrical in shape. It is understood, however, that the drive tube 60 may have other than a circular shaped cross-section, e.g., it may be formed having an oval, square, hexagonal, octagonal, etc. cross-sectional shapes. Likewise, the internally facing pockets 56 and externally facing pockets 58 could be appropriately shaped to accommodate other than cylindrical drive tubes.

The drive tubes 60 are closely fitted within the internally facing pockets 56 and externally facing pockets 58. As such, the drive tubes dissipate torque forces onto the flow diversion sub exerted by the motor 14. The drive tubes also permit fluid to pass therethrough to an exterior of the flow diversion sub through an orifice ring 60, as described in greater detail below.

FIGS. 18-22 show that the flow diversion sub further includes a drive chamber 62 formed by the housing body 18, in particular, by an internally facing annular recess 64 in the housing body spaced from the drive shaft 26. The drive chamber 62 is spaced from the exhaust chamber 54 and not in fluid communication with the exhaust chamber.

Figure 14:
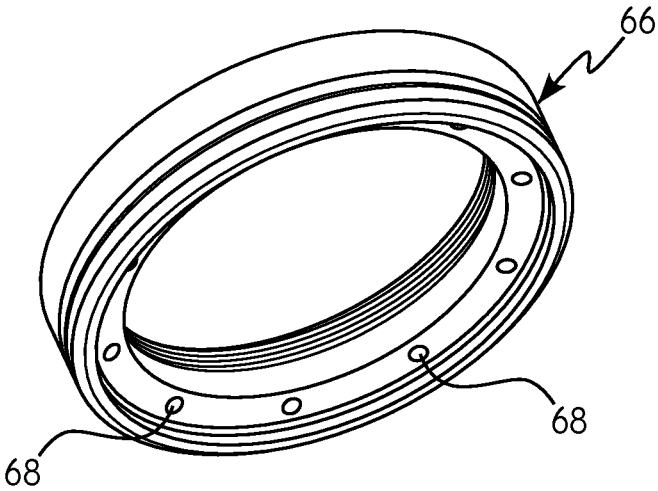
FIG. 14 is a bottom perspective view of an orifice ring of the flow diversion sub of FIG. 1.
Figure 15:
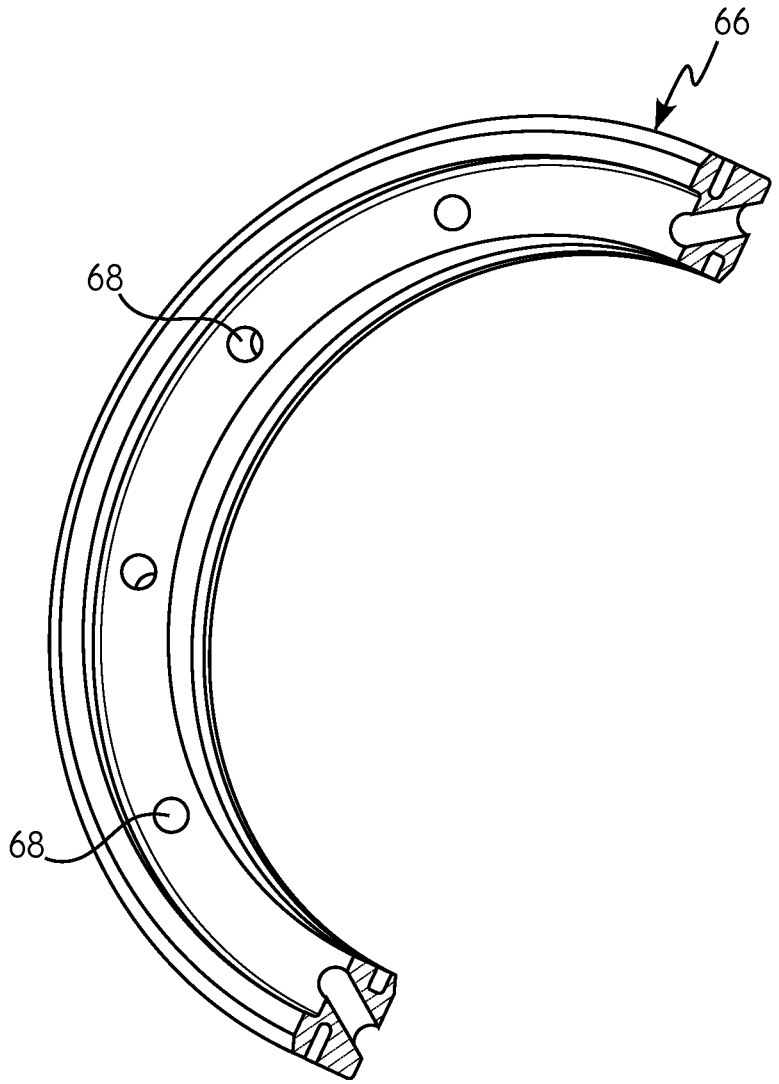
FIG. 15 is bottom perspective cross-sectional view a portion of the orifice ring of FIG. 14.
Figure 16:
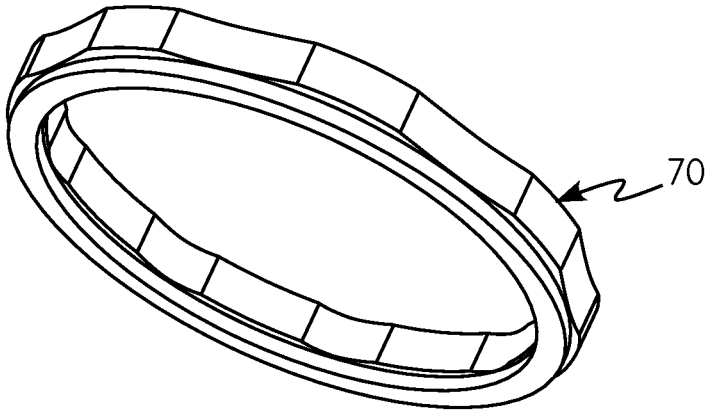
FIG. 16 is a bottom perspective view of a check valve ring for releasably closing the orifices of the orifice ring of FIG. 14.
Figure 17:
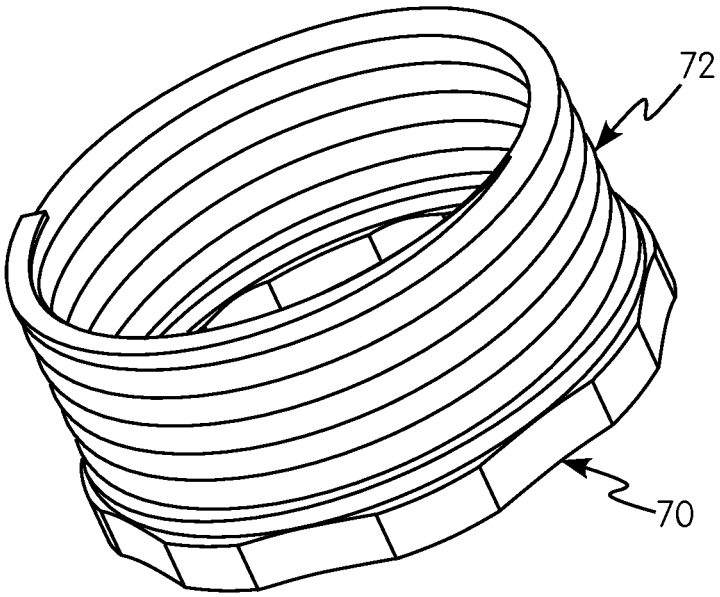
FIG. 17 is a top perspective view of a biasing member and check valve ring of the flow diversion sub of FIG. 1.

FIGS. 2, 11 and 18-22 show that the flow diversion sub further comprises orifice ring 66 having at least one orifice 68 (FIGS. 18 and 20) in fluid communication with the exhaust chamber 54 and an exterior of the flow diversion sub. Enlarged views of the orifice ring 66 are shown in FIGS. 14 and 15. FIGS. 15, 18 and 20 show that the orifices 68 in the orifice ring 66 diverge outwardly from the top of the exhaust chamber 54.

A check valve 70 (FIGS. 2, 11, 16 and 18-22) is situated between the housing body 18 and drive shaft 26 for controlling a flow of air between the housing body and drive shaft through the exhaust chamber. The orifices 68 of orifice ring 66 are covered by the check valve 70. As shown in FIGS. 17-22, a biasing member 72, e.g., a compression spring or the like, circumscribing the drive shaft 26 normally biases the check valve into a sealing position against the orifices 68 of the orifice ring 66.

As shown in FIGS. 18 and 19, the on-bottom drilling mode of the DHD hammer (i.e., first position) (FIGS. 20-22) occurs during drilling when the downward axial force exerted by the weight of the weight collars and drill string causes a lower end 36 of the drive shaft 26 to lower, e.g., come to rest against a seat 38 provided by the cap 20. In other words, the lower end 36 of the draft shaft contacts the seat 38 of cap 20 and thus is in on-bottom contact with the seat 38.

Conversely, the off-bottom circulating mode of the DHD hammer (i.e., second position) occurs when drilling is stopped and the downward axial force exerted by the weight of the weight collars and drill string 12 during drilling is relieved. In that event, the drive shaft 26 unloads due to back fluid pressure contained in the line between the drill motor and the drive shaft, whereby the lower end 36 of the drive shaft 26 becomes separated from the seat 38 of cap 20. In other words, the lower end 36 of the drive shaft separates from the seat 38 of cap 20 and thus is in off-bottom relationship to the seat 38.

In a first position of the drive shaft 26 (FIGS. 18 and 19), the drive shaft 26 is on-bottom in drilling mode, i.e., its lower end 36 is in contact with the seat 38 of cap 20. In this position, the upper central blind hole 28, the first plurality of radial passages (exhaust ports 40), the internally facing annular recess 64, the second plurality of radial passages (receiving ports 50) and the lower central blind hole 30 are in fluid communication with the through hole 34 of the cap 20, whereby drilling fluid circulates then through the flow diversion sub to drive the drill motor.

Referring to FIGS. 20-22, the flow diversion sub 10 is shown as it would appear when in circulating mode (i.e., second position). As shown in these figures, the drive shaft 26 is off-bottom, i.e., its lower end 36 is separated or spaced from the seat 38 of cap 20. When the flow diversion sub is in circulating mode, the pressure of the circulation air passing through the upper central blind hole 28, the exhaust port 40 and exhaust chamber 54 is sufficient to overcome the bias exerted by the biasing member 72 against the check valve 70, whereby air passes through the orifices 68 in the orifice ring 66 (FIG. 20) and flows to the exterior of the flow diversion sub and into the bore annulus.

Depending on the size and shape of the restrictor pin 44, a portion or up to 100% of the working fluid flow to the motor and hammer is directed away from the motor and hammer while circulating, thereby reducing potential wear or other harm to the drill bit of the DHD hammer that may result due to uncontrolled rotation of the motor and bit. Alternatively, the flow direction sub may be configured to direct a portion of flow to the motor or hammer and thus to the bit during circulating mode when controlled rotation of the motor and bit is desired.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

I claim:

1. A flow diversion sub for a down-the-hole drill comprising:

a housing assembly that includes:

a housing body, and a cap extending from the housing body;

a drive shaft having an upper central blind hole and a lower central blind hole spaced from the upper central blind hole, wherein the drive shaft is received within the housing assembly, and wherein one of the housing assembly and drive shaft moves relative to the other of the housing and drive shaft between a first axial position and a second axial position axially spaced apart from the first axial position, and in the first axial position the upper central blind hole is in fluid communication with the lower central blind hole, and in the second axial position the upper central blind hole is at least partially blocked from being in fluid communication with the lower central blind hole.

2. The flow diversion sub of claim 1, wherein the drive shaft further includes an exhaust port in fluid communication with the upper central blind hole.

3. The flow diversion sub of claim 2, wherein the exhaust port is in fluid communication with an exterior of the flow diversion sub when in the second axial position.

4. The flow diversion sub of claim 2, wherein the housing body includes an inwardly extending flange configured to facingly engage the drive shaft either above or below the exhaust port.

5. The flow diversion sub of claim 1, wherein the drive shaft further includes a drive port in fluid communication with the upper central blind hole.

6. The flow diversion sub of claim 5, further comprising a metering device configured to be received in the drive port, wherein the drive shaft further includes a receiving port in fluid communication with the lower central blind hole, and wherein unless the drive port is completely blocked by a metering pin, the drive port is in fluid communication with the receiving port when in the first axial position or the second axial position.

7. The flow diversion sub of claim 6, wherein each of the drive port and receiving port extends substantially radially.

8. The flow diversion sub of claim 6, wherein the drive port is axially spaced from the receiving port.

9. The flow diversion sub of claim 1, wherein the drive shaft further includes a receiving port in fluid communication with the lower central blind hole.

10. The flow diversion sub of claim 1, wherein the drive shaft further includes a restrictor at least partially occluding fluid communication in the upper central blind hole.

11. The flow diversion sub of claim 1, wherein the housing body includes an inwardly extending flange.

12. The flow diversion sub of claim 1, further comprising an exhaust chamber between the housing body and the drive shaft, and wherein the exhaust chamber is in fluid communication with an exterior of the flow diversion sub.

13. The flow diversion sub of claim 12, wherein the exhaust chamber includes a drive tube in fluid communication with an exhaust port when in the second axial position.

14. The flow diversion sub of claim 12, further including a drive chamber formed by the housing body and drive shaft, wherein the drive chamber is spaced from the exhaust chamber and not in fluid communication with the exhaust chamber.

15. The flow diversion sub of claim 1, further including a drive chamber formed by the housing body and drive shaft.

16. The flow diversion sub of claim 1, wherein the cap is releasably connected to the housing body.

17. The flow diversion sub of claim 1, wherein the cap includes a central through hole.

18. The flow diversion sub of claim 1, further comprising a check valve between the housing body and drive shaft for controlling a flow of air between the housing body and drive shaft.

19. A down-the-hole drill assembly comprising:

a drill string;

the flow diversion sub of claim 1 attached to the drill string; and a motor operatively attached to the flow diversion sub.

20. A flow diversion sub for a down-the-hole drill comprising:

a housing including an internally facing annular recess and a plurality of internally facing pockets spaced from the internally facing annular recess;

a drive shaft movably received in the housing and comprising:

an upper portion configured for fluid connection to a drill string or weight collars, the upper portion including an upper central blind hole, and a plurality of externally facing pockets opposite the plurality of internally facing pockets;

a lower portion including a lower central blind hole, an intermediate portion including a first plurality of radial passages in fluid communication with the upper central blind hole, a second plurality of radial passages in fluid communication with the lower central blind hole, and a wall separating the upper central blind hole from the lower central blind hole; and a cap connecting the drive shaft to the housing, the cap having a central through hole beneath and in fluid communication with the lower central blind hole and, wherein the cap is threadably connectable to a motor.

21. The flow diversion sub for a down-the-hole-drill of claim 20, wherein, in a first position of the drive shaft, the upper central blind hole, the first plurality of radial passages, the internally facing annular recess, the second plurality of radial passages and the lower central blind hole are in fluid communication, and wherein, in a second position of the drive shaft, the upper central blind hole, the first plurality of radial passages, the plurality of internally facing pockets, and the plurality of externally facing pockets are in fluid communication with an exterior of the flow diversion sub.

* * * * *